United States Patent [19]

Cammi

[11] 4,382,589

[45] May 10, 1983

[54] WORKBENCH APPARATUS, PARTICULARLY FOR WORKING ON DIESEL ENGINE INJECTION PUMPS

[76] Inventor: Ferdinando Cammi, Via Luigi Einaudi, 8 Piacenza, Italy

[21] Appl. No.: 177,153

[22] Filed: Aug. 11, 1980

[30] Foreign Application Priority Data

Sep. 6, 1979 [IT] Italy ..... 25524 A/79

[51] Int. Cl.[3] ..... B25B 1/22

[52] U.S. Cl. ..... 269/50; 269/15; 269/157; 269/9; 269/283; 269/900; 269/309

[58] Field of Search ..... 269/69-70, 269/15, 77-78, 283, 285, 309, 153-154, 157, 900, 50-51, 9, 45

[56] References Cited

U.S. PATENT DOCUMENTS

| | | | |
|---|---|---|---|
| 2,495,438 | 1/1950 | Bentley et al. | 269/70 |
| 2,568,508 | 9/1951 | Montague | 269/51 |
| 2,969,231 | 1/1961 | Mills | 269/69 |
| 4,125,251 | 11/1978 | Jamieson | 269/900 |
| 4,140,306 | 2/1979 | Wheeler | 269/69 |

*Primary Examiner*—Robert C. Watson

*Attorney, Agent, or Firm*—Guido Modiano; Albert Josif

[57] ABSTRACT

There is disclosed a workbench apparatus intended to enable, at specialized workshop, the servicing of mechanical apparata in general, in particular Diesel engine injection pumps. The apparatus, which is easily operable by any skilled operator and enables the supported members to be positioned as desired through simple and reliable members and controls, comprises a clamping device carried rotatably by a base and having snap-action positioning members, and connection elements including both insertion members in form of pins insertable into seats of the clamping device, and supporting members fixedly engageable with the pump or the like to be worked on. The seats are partially open laterally and the pins are clamped in the seats by clamping members engaging the pins at the points where the seats are open.

7 Claims, 10 Drawing Figures

WORKBENCH APPARATUS, PARTICULARLY FOR WORKING ON DIESEL ENGINE INJECTION PUMPS

BACKGROUND OF THE INVENTION

This invention relates to a workbench apparatus, particularly for working on Diesel engine injection pumps, and broadly to a workbench apparatus adapted for supporting and positioning at will any types of mechanical or electrical apparata to be processed or serviced.

As is known, there exist a variety of Diesel engine injection pumps, which differ from one another both by their design and overall dimensions.

These pumps, which constitute a basic and characteristic item of equipment on Diesel engines, must be periodically checked, tested, serviced, and repaired or altered, at scheduled intervals, at workshops equipped with special work and test benches.

A basic and important step of each such operations is the securing of the pumps to the bench; the more secure is the installation of the pump to the bench, the easier is the carrying out of the operation itself.

In actual practice, since the operations carried out on such injection pumps are both numerous and varied, for positioning and supporting a pump on the bench, an apparatus is needed which enables the pump to be secured firmly in several different positions, i.e. positions which are mutually rotated both with respect to a vertical rotation axis and to a horizontal rotation axis.

Currently, such requirements are met by workbench apparata which comprise essentially a base rotatably supporting a turret wherethrough a bar extends which is directed perpendicularly to the turret axis. With said bar, there engage brackets and other movable elements which may be connected to the pump to result in a sort of enclosure for parts thereof, and both the bar and turret can be rotated about their respective axes and locked at selected positions.

It has been found that such apparata only lend themselves for supporting and positioning injection pumps having in-line pumping units, whereas other pumps must be supported and positioned in a wholly empirical manner on the workbench, using a rather primitive type of equipment which is scarcely suitable for the job and does not allow the pump to be disposed in any required positions.

Moreover, it has been found that the improved workbench apparatus mentioned hereinabove has considerable disadvantages even when in-line pumps are installed thereon; for example, the pumps do not occupy a stable position on the apparatus, and upon releasing a locking device for said cross bar, to change the pump position, the pump receives no support.

SUMMARY OF THE INVENTION

In view of the foregoing situation, this invention sets out to provide a workbench apparatus which eliminates the cited drawbacks, and which in spite of the large variety of existing injection pumps and given the need of securing and positioning them in many different ways, is practically universal in operation and suitable for carrying out almost any types of jobs thereon.

Within that general aim, it is another object to provide a workbench apparatus according to the invention which is also advantageous from the standpoint of constructional simplicity, low cost, reliability, and strength, such as to be readily usable by any skilled operator.

According to one aspect of the present invention, there is provided a workbench apparatus, particularly for working on Diesel engine injection pumps, having a base and means for engaging an injection pump, said means being rotatably carried by said base, characterized in that said means comprise connection elements having rigid supporting members fixedly engageable with said injection pump and rigid insertion members made rigid with said supporting members, and at least one clamping device directly supported by said base and operative to controllably clamp said insertion members, said clamping device being provided with seats enabling the insertion of said insertion members, said insertion members being configured such as to engage said seats at a plurality of positions of said injection pump when said injection pump is fixedly engaged with said connection elements through said supporting members.

BRIEF DESCRIPTION OF THE DRAWINGS

Further features and advantages will be more clearly apparent from a decription of preferred, but not limitative, embodiments of this invention, shown by way of example only in the accompanying drawings, where.

DESCRIPTION OF THE PREFERRED EMBODIMENTS

Figure 1:
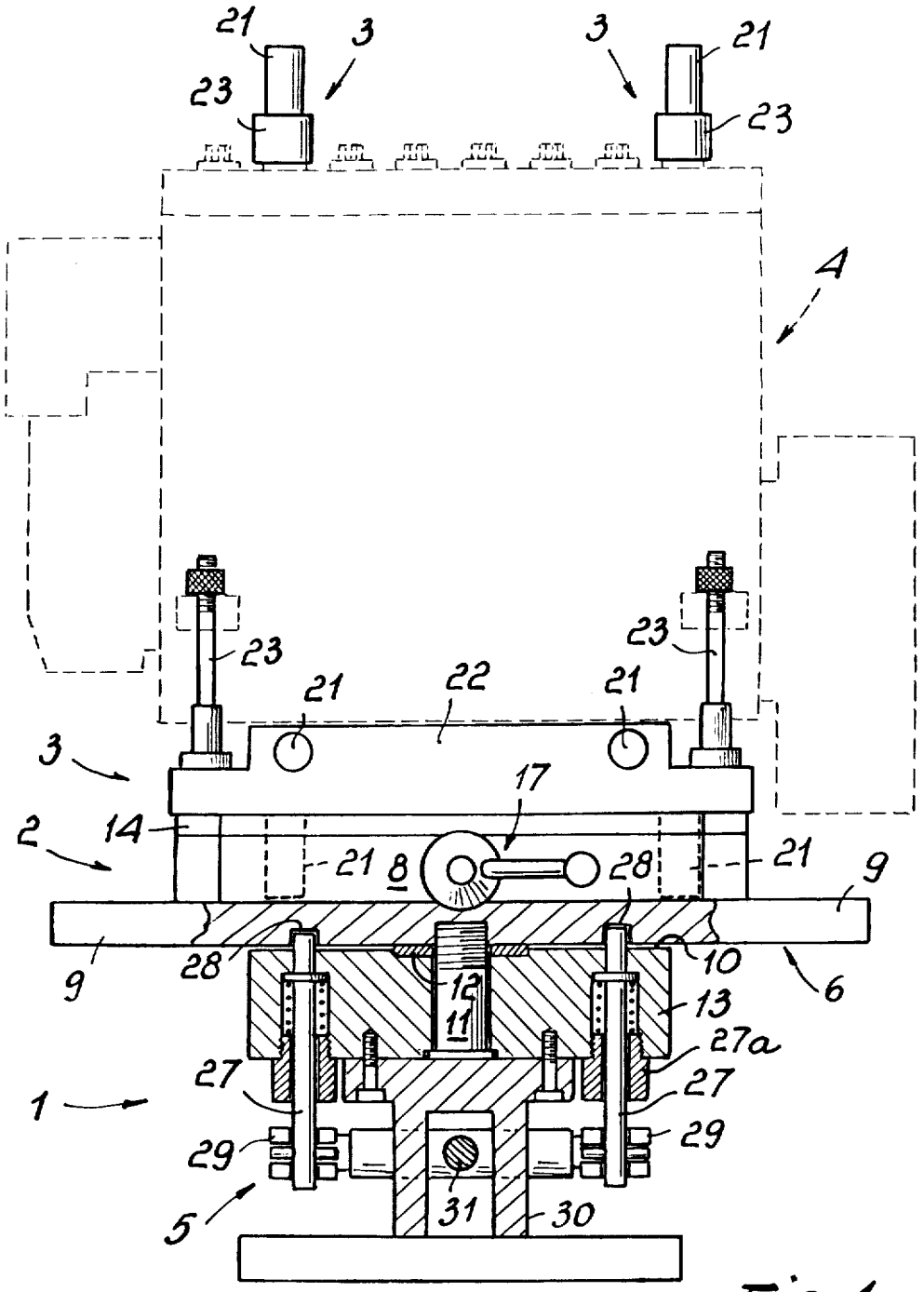
FIG. 1 is a partly sectional front view of an apparatus according to the invention, as connected to an injection pump schematically shown in ghost lines.

With reference to the drawing figures, the workbench apparatus according to the invention, comprises essentially a base 1, a clamping device 2 carried rotatably above the base 1, and a plurality of connection elements 3 removably insertable in the clamping device 2 and adapted for direct attachment to an injection pump, as indicated at 4, or an electric motor, or more generally to a mechanical or electrical article or apparatus.

With the base 1, there are associated snap-action positioning members 5 effective to determine the angular position of the clamping device 2.

More specifically, the clamping device 2 comprises a clamping block 6 having a plurality of seats 7 whereinto are inserted insertion members of said connection elements 3, and opppositely located clamp members in form of jaws 8 which are inserted into the block 6 adjacent the seats 7.

Figure 4A:
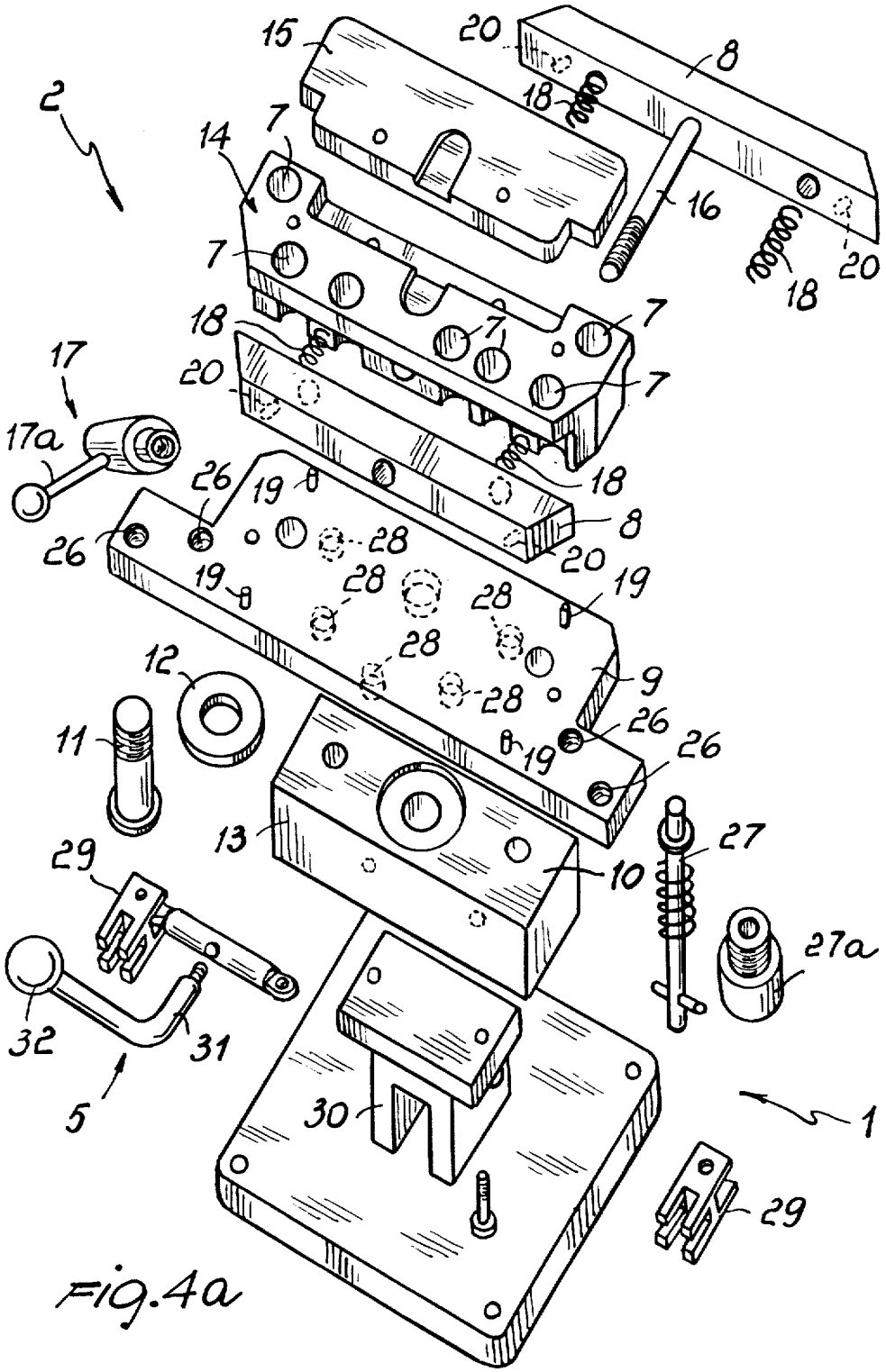
FIG. 4*a* is a perspective exploded view of the components of the apparatus shown in the preceding figure.

Construction-wise, the block 6 may comprise, as evidenced in FIG. 4*a*, a bottom plate 9, arranged rotatably onto a washer 12 made of a low frictional coefficient material, protruding from a resting surface 10 defining the top face of the base 1. From the resting surface 10, and coaxially with the washer 12, there projects a pivot 11 journalled in the bottom plate 9. The pivot 11, as shown in FIG. 1, comprises a tube which is rotatably inserted through the top portion 13 of the base 1, and terminates with a threaded portion providing permanent engagement with the bottom plate 9.

Also construction-wise, as shown in FIG. 4a, the block 6 of the clamping device 2 is provided with a substantially solid shaped element 14 which is attached to the bottom plate 9 and has said seats 7 therein and the necessary recesses for the insertion of the jaws 8. Moreover, the shaped element 14 supports a cantilever projecting rest plate 15 extending parallel to the bottom plate 9.

The seats 7 comprise a plurality of mutually parallel bores, having their axes perpendicular to the bottom plate 9 and defining a series of bores along each major lonigtudinal side of the shaped element 14. Furthermore, the seats 7 are partially open toward the jaws 8.

The opposite jaws 8, which are disposed symmetrically at the major longitudinal sides of the shaped element 14, are connected by a stem 16 which at one end is firmly connected to a jaw 8 and at the opposite end is threaded such as to freely pass through the other jaw 8 and then receive a handle grip 17 matchingly threded to the stem 16. The handle grip 17 has any known construction enabling the lever 17a to be positioned as desired regardless of the extent of its threaded engagement on the stem 16.

Small compression springs 18 are arranged between the jaws 8 and shaped element 14 to urge the jaws 8 away from each other. FIG. 4a further illustrates a structure adapted for limiting the travel extent of the jaws 8 away from each other, e.g. comprising projections 19 rising from the bottom plate 9 and penetrating slots 20 formed in the bottom portion of the jaws 8. The length of the slots 20 will establish or control the travel distance and travel limits for each jaw.

The connection elements 3, which are positionable on the cited clamping device 2, comprise both rigid article supporting members, fixedly engageable with a pump or the like device, and rigid insertion members adapted for direct engagement by the clamping device 2.

More in detail, said insertion members comprise pins 21, slidably insertable into the seats 7 and then lockable by the jaws 8.

Each connection element 3 has at least one pin 21. In the instance illustrated in FIG. 7, a connection element 3 is shown which has a single pin 21. FIGS. 1, 2, 5, 6 and 9 show instead connection elements 3 pins arranged according to directions forming an angle between each other, namely having two pairs of pins 21, the pins in each pair being parallel to each other, and the pins in different pairs being perpendicular to one another. The pins 21, when more than one, protrude from a connection body 22. In that instance, the length of the pins 21 and shape of the connecting body 22 are such as to allow the connecting body 22 to rest directly onto the shaped element 14.

Figure 3:
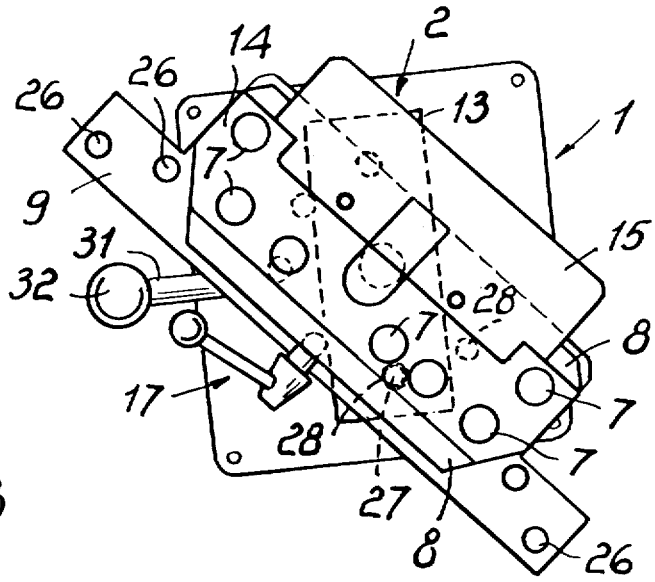
FIG. 3 is a plan view of a major portion of the apparatus of FIG. 1, the pump and elements more directly related thereto being omitted.
Figure 6:
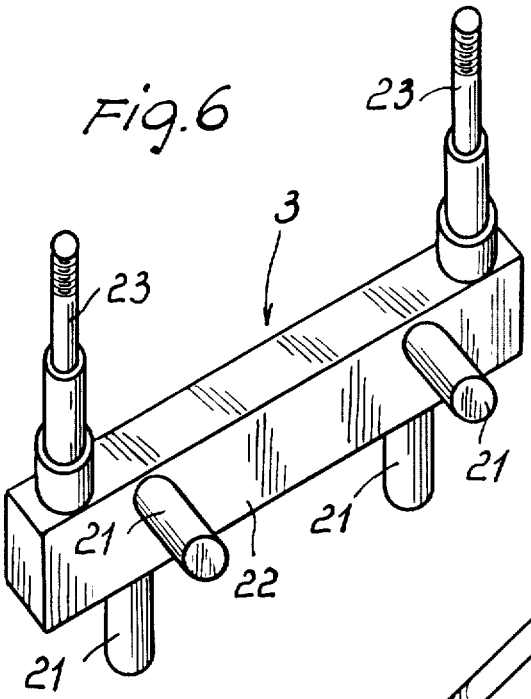
FIGS. 5 to 9 are perspective views of connection elements to be inserted in the apparatus shown in the preceding figures.
Figure 5:
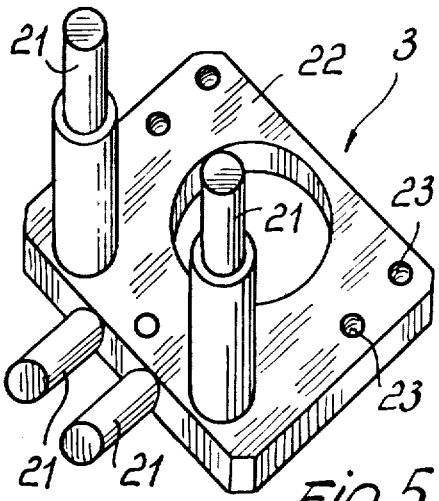
Figure 9:
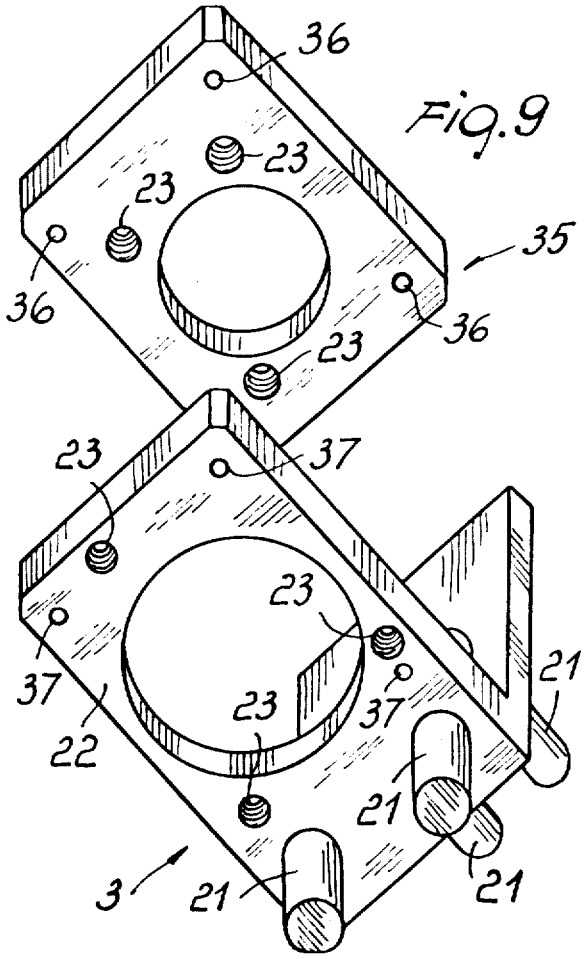
Figure 7:
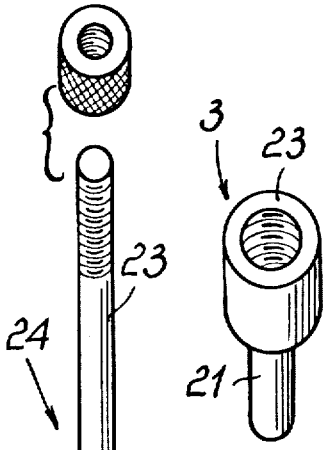

The supporting members of the connection elements 3 are in the form of fixed mounts 23 adapted for engagement, for example, with a pump 4, in this case at the very supports provided for attaching the injection pump to an engine, as shown schematically in FIG. 1 and FIG 3. It should be noted that the fixed mounts 23 may comprise a simple nut as shown in FIG. 7, and a pair of parallel screws as shown in FIG. 6, or alternatively, a shaped flange formed with a passageway for the insertion of screws, as shown in FIGS. 5 and 9. FIG. 9, in particular, shows by way of example a connection ewlement 3 for securing electric motors to the workbench apparatus. Moreover, FIG. 9 evidences how one connectin element 3 can be adapted for supporting various pumps or electric motors, or the like devices. In fact, an adaptor plate 35 or the like element may be provided for engagement with the connection elements 3 through, for instance, specially provided threaded holes 36, in the adaptor plate, and 37, in the connection element 3. The adaptor plate 35 will be in turn provided with suitable fixed mounts 23.

In actual practice, the connection elements 3 will reflect as many shapes as are the types of pumps or similar devices to be attached thereto, and the connection elements shown in the drawings are only intended for illustration purposes. In particular, the connection elements 3 of FIGS. 1, 2 and 6 are intended for medium size injection pumps or multi-plunger in-line pumps; the connection element 3 of FIG. 5 is intended for a small size pump or single plunger pump; and the connection element 3 of FIG. 7, where the simplification has been carried to a maximum, is intended for large size injection pumps and engages, together with other connection elements of the same type, threaded nozzles provided on the sides of such pumps, as shown in FIGS. 1 and 2.

Figure 8:
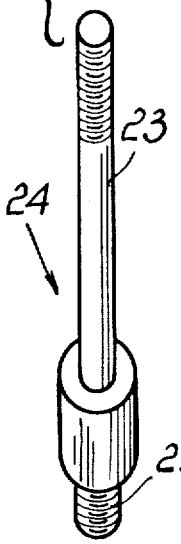

FIG. 8 shows how the workbench apparatus or fixture according to this invention may also be adapted, with a few modifications, for supporting very large size injection pumps of less than frequent occurrence; in such exceptional cases, which may not justify a specific re-designing of the whole apparatus, auxiliary mounts 24 would be utilized which are provided coaxially with threaded couplings 25 which are inserted and threaded into auxiliary threaded holes 26 formed at the end edges of the bottom plate 9, as shown in FIG. 4a.

Figure 2:
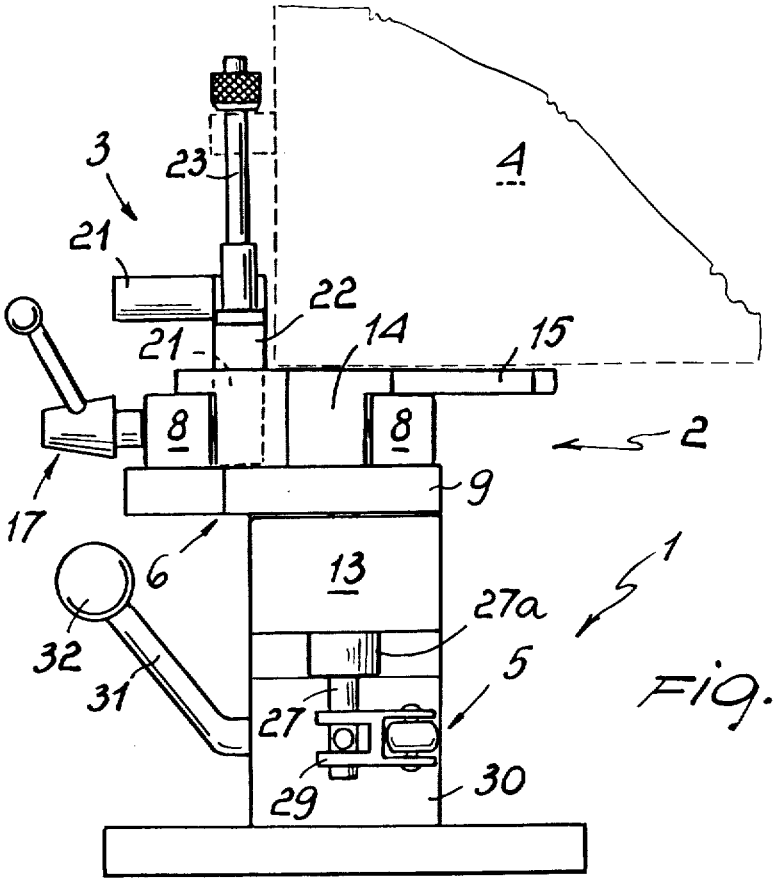
FIG. 2 is a side view of the same apparatus of FIG. 1.

The clamping device 2, with the connection elements 3 inserted therein, is not only rotatable about a vertical axis, i.e. the axis of the pivot 11, but also positionable by snap-action through said rotational movement, by means of said snap-action members 5, best shown in FIGS. 1 and 2.

Said mewmbers comprise locking pins 27 penetrating bushings 27a and the top portion 13 of the base 1, to engage in specially provided recesses 28 under the bottom plate 9 which are arranged along a circumference centered on the pivot 11. The pins 27 are spring loaded toward their positions of engagement in the recesses 28, and at the end opposite to the end inserted in said recesses, they are engaged by a respective rocking yoke 29, which engages a respective end of a control bar extending in a direction transverse to the pins 27, spaced therefrom, and rotatably arranged in the base 1 at upright 30. Centrally inside the upright 30, which has suitable cutouts formed through its wall, the control bar is rigid with a lever 31 protruding outwardly from the base 1 and terminated with a knob 32.

Figure 4B:
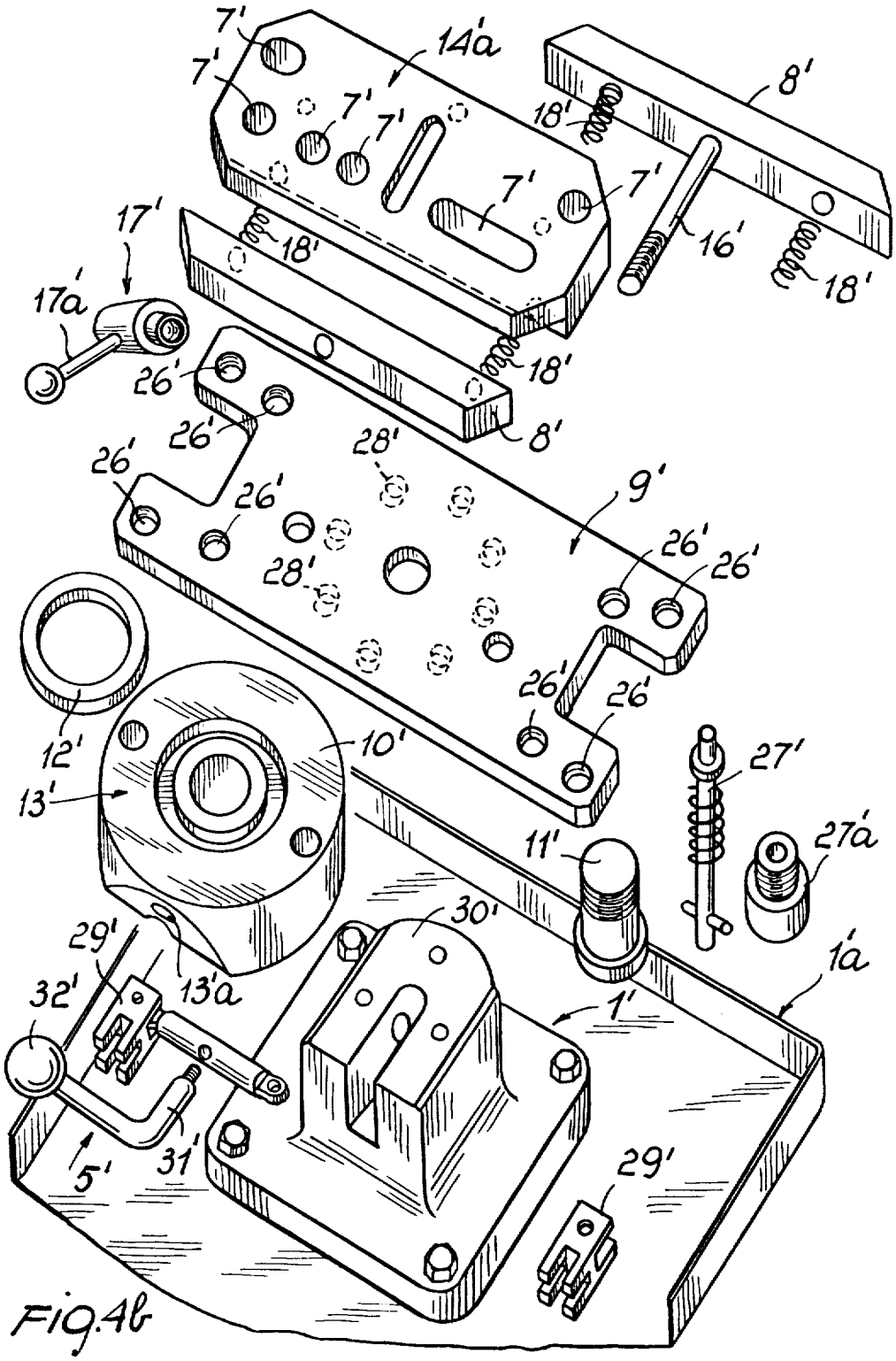
FIG. 4*b* shows, similarly to FIG. 4*a*, an apparatus incorporating constructional modifications.

With reference to the specific and not limitative example of a workbench apparatus or fixture described hereinabove, it should be noted that many of the cited elements are fastened to one another by means of screws which have not been specifically mentioned because this type of connection is obvious and may easily be substituted with other types of connections. FIG. 4b illustrates an example of a workbench apparatus according to the invention which carries slight modifications which do not depart from the scope of the inventive concept illustrated in the cited drawing figures. It should be noted that as shown in FIG. 4b, which is similar to FIG. 4*a*, a base is inserted into an oil collecting pan 1'*a*, and that the base itself comprises an upright or column 30' integrally connected to the supporting wing at the base thereof. The top portion 13' of the base 1' receives a washer 12' and is no longer parallelepipedal in shape, but rather in the form of a bevelled cylinder, and at that bevel a conduit 13'*a* is provided for admitting lubricating oil to said pivot 11. It will be noted that the pivot 11' of FIG. 4*b* has been made considerably oversize with respect to the pivot 11 of FIG. 4*a*. The bottom plate 9' of FIG. 4*b* has a substantially symmetrical "H" shape. In practice, there are symmetrically doubled those end edges which are provided with threaded holes 26' and wherewith the auxiliary mounts 24 engage.

Furthermore, the bottom plate 9' has recessed 28' which, in addition to being arranged along a circumference centered on the pivot 11', also define and complete that circumference, thereby both pins 27' will be always inserted into a pair of recesses 28', at various angular position of the bottom plate 9'.

FIG. 4*b* also shows a shaped element 14' forming an integral piece 14'*a* with the resting plate 15', and seats 7' which may have a desired advantageous and peculiar position and configuration.

More specifically, the seats 7' are no longer invariably circular, but partly circular bores and partly elongated slots with a main extension direction perpendicular to one another (FIG. 4*b*). The seats 7' of slotted shape, moreover, are spaced apart from the circular cross-section seats 7' such that the insertion members of the connection elements 3, namely the pins 21, are inserted partly into the circular seats and partly into the slotted seats.

Thus, the range of connection elements 3 which can be engaged in said seats is considerably and uniquely widened, since the engagement no longer requires the provision of pairs of pins 21 located at accurately determined reciprocal distances. It is only necessary that the distance between the pins does not exceed certain maximum or minimum values related to the length of said slots. It is noteworthy that this wide selective faculty of insertion of the pins 21 is of no prejudice for their stability; the provision of circular seats and the width dimension of the slots being adequate to prevent any undesired play.

The operation of this workbench apparatus will be apparent from the foregoing description.

An injection pump 4 for Diesel engines, or any other device having similar requirements, is secured to the fixed mounts 23 by screw fasteners, such as to make it rigid with a suitable connection element 3. Then the connection element 3 is positioned above the clamping device 2 such that its coupling members or pins 21 penetrate the seats 7. As shown best in FIGS. 1 and 2, the connection elements 3, which have a dual pair of pins 21, may be inserted at will in the clamping device 2, at two 90° angled positions depending on the pair of pins 21 which has been inserted into said seats 7.

After having been inserted in the clamping device 2 such that the seats 7 in the shaped element 14 receive selected pins 21, the connection element 3 may be locked by the jaws 8; by turning the handle grip 17 the jaws 8 are brought closer to each other against thew small compression springs 18, until the jaws arrange themselves at a position of interference with the pins 21 which protrude from the open sides of the seats 7.

Thus, the injection pump 4 is held securely, with the interposition of the connection element 3, and suppordted both at the shaped element 14 and the resting plate 15 of the block 6.

The angular position of the pump with respect to a vertical axis of rotation is adjusted by means of the snap-action positioning mewmbers 5; by manually lowering the handle 31, the rocking yoke 29 is turned and the pins 27 move downwards, which pins will then disengage from the recesses 28 in the bottom plate 9. Thus, the entire clamping device 2 is fully rotatable about the pivot 11 while resting on the anti-friction material washer 12.

To re-lock the bottom plate 9, it will suffice that the handle or lever 31 be released, the bias of the springs acting on the pins 27 causing the same to enter the recesses 28, thus setting the apparatus stably in the most comfortable position.

The invention achieves its objects. In fact, a workbench apparatus or fixture has been provided which is virtually universal in application, in that it is capable of supporting securely and reliably practically any type of injection pumps currently in use, as well as electric motors and similar equipment.

Moreover, this apparatus enables said pumps or the like to be positioned in a plurality of desired positions, the pumps or the like being at all times supported in a stable manner, even after said clamping device has been released, because the pins 21 remain in the seats 7.

The construction provided is quite simple and economical, even when the fact is neglected that it can replace any of the existing apparata for similar purposes, thanks to its basic universal characteristics.

The invention as described is susceptible to many modifications and variations, in addition to those described hereinabove, without departing from the true scope of this inventive concept. For example, all of the elements which make up the block 6 may be formed integrally or in one piece, and all of the details described may be replaced by other technically equivalent elements.

In practicing the invention, the materials and dimensions may be any ones to suit individual requirements.

What is claimed is:

1. A workbench apparatus for working on articles, particularly Diesel injection pumps, comprising a base and means supported by said base for carrying an article to be worked on, said means comprising at least one connection element having article supporting members for fixedly engaging said article and rigid insertion members in form of pins, and at least one clamping device rotatably supported by said base to be fixable thereon at different angular positions, said clamping device having a plurality of seats for receiving said pins of said at least one connection element and means for clamping said pins in said seats, wherein said pins are arranged on said at least one connection element according to directions forming angles between each other and said seats are arranged in said clamping device at positions such as to receive selected of said pins to allow positioning of said at least one connection element and article at plural angled positions with respect to said clamping device, and wherein said clamping device comprises a clamping block rotatably supported by said base, said clamping block comprising a shaped element having said seats machined therein such as to be partially open laterally, and clamp members for clampingly engaging said pins in said seats at points where said seats are open.

2. A workbench apparatus as claimed in claim 1, wherein said clamp members engage major longitudinal sides of said shaped element from opposite sides.

3. A workbench apparatus as claimed in claim 1, wherein said seats are in the form of bores arranged adjacent two longitudinal sides of said shaped element such as to define a series of parallel bores at each longitudinal side of said shaped element.

4. A workbench apparatus as claimed in claim 1, wherein each of said clamp members comprises a jaw, said jaws being arranged at opposite major longitudinal sides of said shaped element, and wherein means comprising a handle grip are provided for tightening said jaws towards said shaped element.

5. A workbench apparatus as claimed in claim 1, wherein said shaped element has at the top a cantilever projecting rest plate for said article.

6. A workbench apparatus as claimed in claim 1, wherein said clamping device comprises a clamping block rotatably supported by said base, said clamping block having on a side facing said base a plurality of recesses arranged on a circumference concentrical to a pivot pin of said block, locking pins resiliently urged into said recesses, a control bar rotatably arranged in said base transverse to said locking pins and spaced therefrom, a lever for rotating said control bar, and a rocking yoke between each end of said control bar and a respective one of said locking pins, whereby lowering of said lever causes disengagement of said locking pins from said recesses.

7. A workbench apparatus as claimed in claim 1, wherein said seats comprise in part circular cross-section bores and in part elongate slots extending perpendicularly to one another, said circular bores and said elongate slots enabling different positioning of said at least one connection element on said clamping device.

* * * * *